United States Patent [19]

Stahlecker

[11] Patent Number: 4,691,509

[45] Date of Patent: Sep. 8, 1987

[54] OPEN-END FRICTION SPINNING MACHINE

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 898,848

[22] Filed: Aug. 19, 1986

Related U.S. Application Data

[63] Continuation of Ser. No. 692,972, Jan. 22, 1985, abandoned.

[30] Foreign Application Priority Data

Jan. 25, 1984 [DE] Fed. Rep. of Germany ..... 3402367

[51] Int. Cl.[4] ..... D01H 7/882; D01H 13/26

[52] U.S. Cl. ..... 57/264; 57/93; 57/401; 57/411

[58] Field of Search ..... 57/264, 400, 401, 404, 57/409, 411, 415

[56] References Cited

U.S. PATENT DOCUMENTS

| | | | |
|---|---|---|---|
| 3,895,483 | 7/1975 | Grau | 57/264 X |
| 3,922,839 | 12/1975 | Sakurai et al. | 57/411 |
| 4,007,457 | 2/1977 | Aeppli | 57/264 |
| 4,015,414 | 4/1977 | Sholly, Jr. | 57/264 |
| 4,020,622 | 5/1977 | Lattion | 57/264 X |
| 4,043,107 | 8/1977 | Günther et al. | 57/264 |
| 4,084,398 | 4/1978 | Stahlecker et al. | 57/264 X |
| 4,137,699 | 2/1979 | Stahlecker et al. | 57/264 |
| 4,502,272 | 3/1985 | Fuchs | 57/401 |

FOREIGN PATENT DOCUMENTS

| | | | |
|---|---|---|---|
| 2944219 | 7/1980 | Fed. Rep. of Germany | 57/264 |
| 1393663 | 9/1973 | United Kingdom . | |

*Primary Examiner*—Stuart S. Levy
*Assistant Examiner*—Joseph J. Hail, III

[57] ABSTRACT

In the case of an open-end friction spinning machine having a plurality of spinning units, measuring devices are provided for examining the quality of the moving yarn at each spinning unit. Preferably, the tension of the yarn between a withdrawal device and the yarn forming point is measured which permits the drawing of conclusions concerning the respectively existing yarn twist. When deviations from an indicated quality are determined, measures are taken so that at least one parameter of the spinning conditions at the respective spinning unit is changed for eliminating the deviations.

22 Claims, 4 Drawing Figures

10
11
1
12
53
33
28
29
59
58
54
57
56
26
27
32
70
71
38
31
30
68
55
67
69
7,8
9
19
60
18
6
20,21
79
36
37
16
46
39
34
42
35
49
48
45
4
47
50
44
43
40
41
5
51
52
61
63
62
64
65
66

OPEN-END FRICTION SPINNING MACHINE

This is a continuation of application Ser. No. 692,972, filed Jan. 22, 1985 now abandoned.

BACKGROUND AND SUMMARY OF THE INVENTION

This invention relates to an open-end friction spinning machine having a plurality of spinning units. Each spinning unit has two friction rollers that are arranged next to one another to form a wedge-shaped gap serving as a yarn forming point or region. The friction rollers are drivable in the same rotational direction to carry out spinning operations. Each spinning unit also has a feeding and opening device for the feeding of fibers to the wedge-shaped gap, a suction device for holding the fibers and the forming yarn in the wedge-shaped gap, and a withdrawal device for withdrawing the formed yarn in the longitudinal direction of the wedge-shaped gap.

In order to spin the best possible yarn quality in open-end friction spinning when using differing fiber material, the open-end friction spinning machine is subjected to a basic setting up of spinning conditions that is adapted to that fiber material. In this case, the effect of the suction devices on the wedge-shaped gaps of the spinning units, the circumferential speeds of the friction rollers, the feeding speed of the fiber material, the speed of the opening roller, and the withdrawal speed are adjusted. Even in the case of a good basic adjustment, fluctuations in quality may occur during the spinning of a batch which may be the result of the fact that starting material does not always have the same character and quality, or that temperature fluctuations occur or that the degree of moisture of the starting material is not always the same, or that the fiber mixture and blend fluctuates within one batch, especially in the case of natural fibers and similar materials.

The invention is based on the objective of developing an open-end friction spinning machine of the initially mentioned type in such a way that fluctuations in the quality of the yarn are avoided as much as possible during the operation of the open-end friction spinning machine.

This objective is achieved by equipping each spinning unit with individually adjustable means for changing at least one parameter of the spinning conditions, by providing at least one measuring device for examining the quality of the moving yarn produced at the individual spinning units and by providing an evaluating device for evaluating the signals of the measuring device which, in the case of deviations from indicated desired values, triggers an adjustment of the means for changing at least one parameter of the spinning conditions.

The invention is based, at least in part, on the recognition that in open-end friction spinning, because of the variations in the starting material or of the degree of moisture in the starting material, or similar circumstances, the spinning conditions change especially with respect to the friction effect in the area of the yarn forming point so that either too much twist or—which is even less favorable—too little twist is applied to the yarn. These fluctuations in quality are avoided by changing the friction effect at each spinning unit when diminished quality is determined in such a way that the desired quality value is reached again.

In a development of the invention, it is provided that each spinning unit is equipped with means for adjusting the effect of the suction device. The effect of the suction device is one of the important parameters of the spinning conditions because it determines to a large extent the amount of twist that is applied. When the suction effect is too low, a relatively extensive slip is created between the forming yarn and the shell or cover surfaces of the friction rollers without the application of a sufficient twist to the yarn. When, on the other hand, the suction effect is too high, an excessive twist may be applied.

In a further development of the invention, it is provided that each spinning unit is equipped with a single motor for driving its friction rollers, the speed of which motor can be adjusted. The circumferential speed of the friction rollers is a second important parameter of the spinning conditions in regard to the twist applied to the yarn so that a changing of the speeds of the friction rollers also permits an adaptation of the quality of the yarn to the desired value with respect to the applied twist in a simple manner.

In a further development of the invention, it is provided that each spinning unit is equipped with a measuring device arranged in the travel path of the yarn. In combination with an evaluating device which is permanently connected with the measuring devices, it is therefore possible to continuously monitor the quality of the yarn and to intervene immediately at the respective spinning unit when a need for a change is determined.

In order to reduce technical expenditures for the open-end friction spinning machine, it is provided in a further development of the invention that the evaluating device is arranged in a servicing apparatus that can be moved along the spinning machine and can be selectively applied to the individual spinning units, said servicing apparatus being equipped with adjusting elements for actuating the means for changing at least one parameter of the spinning conditions. In a further development of the invention, the servicing apparatus is equipped with a measuring device that can be applied to the moving yarn of a spinning unit. In this case, only a periodic monitoring of the yarn quality at the individual spinning units is carried out, which in practice will be sufficient in most cases.

In a further development of the invention, it is provided that the measuring device or measuring devices is/are developed as a yarn tension sensor or as yarn tension sensors. Such yarn tension sensors are relatively simple devices which also are relatively precise in their operation. The tension of the yarn can provide information on the twist existing in the yarn so that the tension of the yarn permits a monitoring of the quality of the moving yarn. In this case, it is especially advantageous for the yarn tension sensor or sensors to be applied to the moving yarn in the area between the friction rollers and the withdrawal device. The yarn tension measured at this point provides information on the friction effect in the area of the yarn forming points since the formed yarn is withdrawn against this friction effect. By means of the tension of the yarn, information can therefore be provided on the friction effect and thus on the twist applied to the yarn or the twist deviations with respect to desired value.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
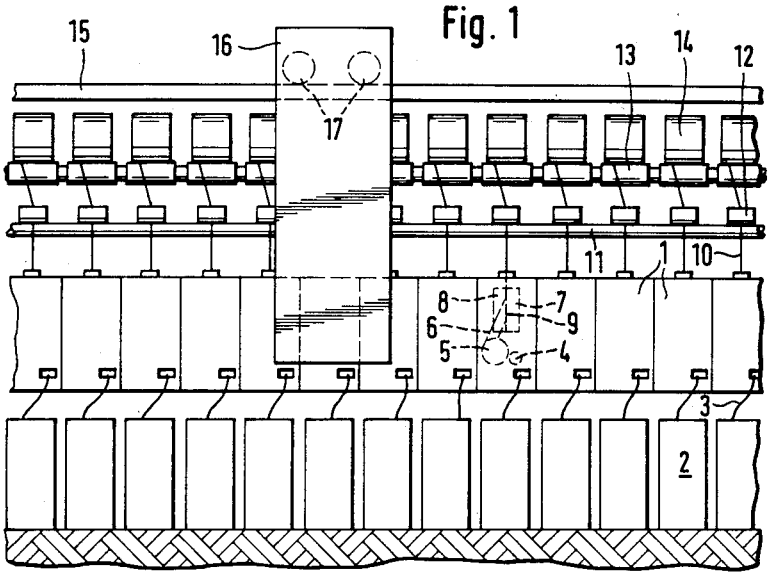
FIG. 1 is a partial front view of an open-end friction spinning machine having a movable servicing apparatus, constructed in accordance with preferred embodiments of the invention.

The open-end friction spinning machine shown in FIG. 1 has a plurality of similar spinning units 1 that are arranged next to one another. A sliver 3 is fed to each of these spinning units 1 from a can 2, said sliver 3 being spun into yarn 10 which is withdrawn from the spinning unit 1 by means of a withdrawal device including a drivable bottom roller 11 running through in the longitudinal direction of the machine and a pressure roller 12 assigned to each spinning unit 1. The withdrawn yarn 10 is subsequently wound onto a winding spool 14 which, in each case, rest on and are driven by grooved drums 13 arranged on a joint shaft running through in the longitudinal direction of the machine.

The sliver 3 is pulled into each spinning unit by means of a feeding roller 4 interacting with a feeding table that is not shown and is offered to the circumference of an opening roller 5 rotating much more rapidly, said opening roller 5 combing out the sliver 3 and separating it into individual fibers. The single fibers are then fed to the yarn forming point via a fiber feeding duct 6. The yarn forming point is the wedge-shaped gap 9 formed by the two friction rollers 7 and 8. The yarn 10 is withdrawn in the longitudinal direction of gap 9.

Figure 2:
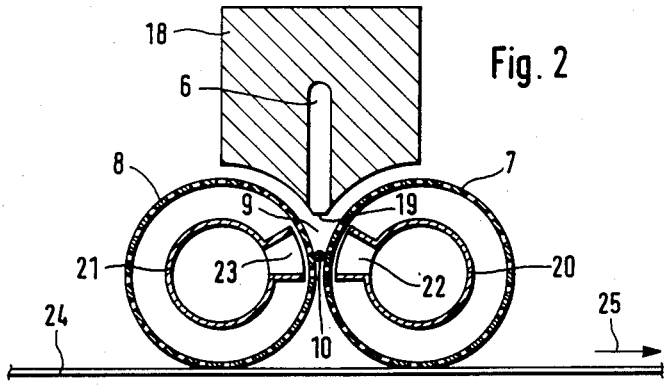
FIG. 2 is an enlarged, approximately horizontal sectional view through an individual spinning unit of the open-end friction spinning machine of FIG. 1.
Figure 3:
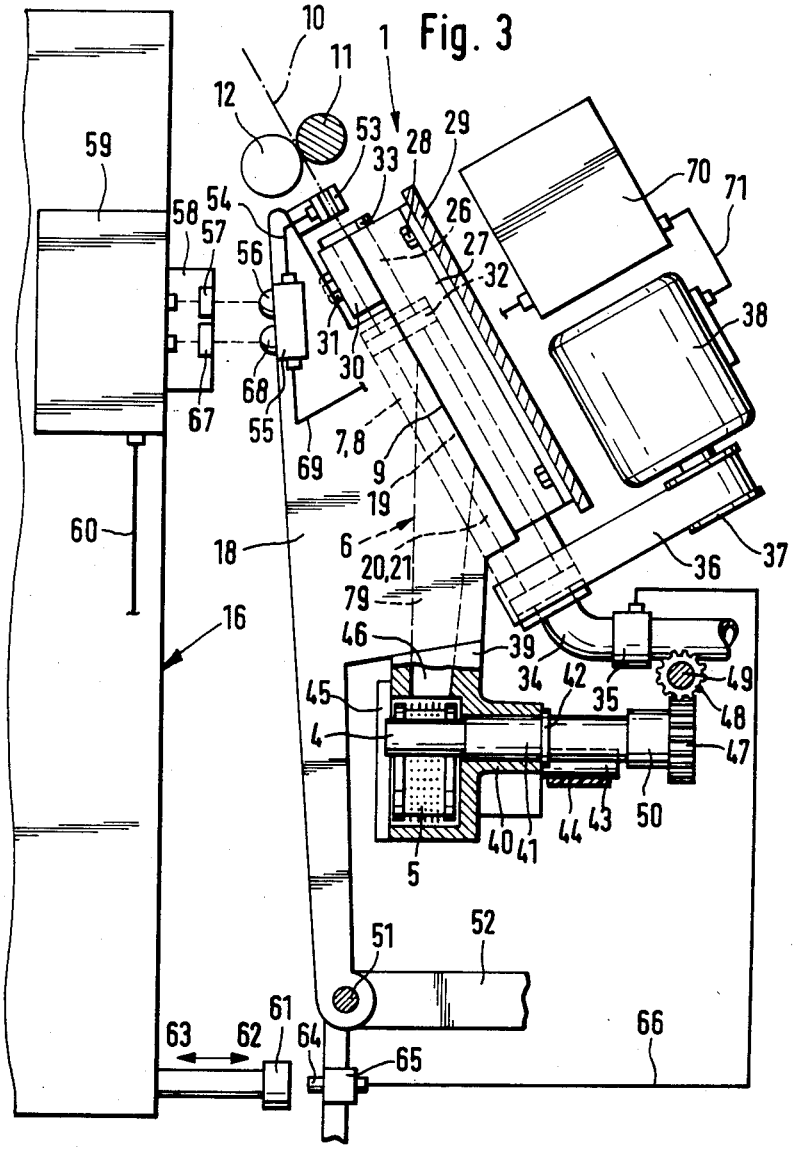
FIG. 3 is a partial lateral sectional view of an individual spinning unit having a movable servicing apparatus, constructed in accordance with preferred embodiments of the invention.

The friction rollers 7 and 8 (FIG. 2) that are arranged closely next to one another and in parallel with respect to one another have perforated shell cover surfaces and are disposed directly on suction pipes 20 and 21 by means of roller bearings 32 (FIG. 3). The suction pipes 20 and 21 are connected to a vacuum pipe leading to a vacuum source via a connection piece 34 and a control valve 35. The suction pipes 20 and 21 are tightly closed on their other end faces and are provided with suction slots 22 and 23 which are delimited by webs projecting up to close to the inside surfaces of the friction rollers 7 and 8 and aiming in the direction of the wedge-shaped gap 9. Via this suction device formed by the suction pipes 20 and 21, an air current is generated through the perforated shell surfaces of the friction rollers 7 and 8 in the area of the wedge-shaped gap 9 for holding the arriving fibers and the forming yarn 10 in the tapering area of the wedge-shaped gap 9.

The air current generated in the suction pipes 20 and 21 also causes a conveying air current in the fiber feeding duct 6 for the fed fibers that is aimed in the direction of the wedge-shaped gap 9. The fiber feeding duct 6 is formed in a part 18 of the housing and with its mouth 19 extends in a slot-shaped manner in the longitudinal direction of the wedge-shaped gap 9 at a narrow distance from it.

In the embodiment according to FIG. 2, the drive of the friction rollers 7 and 8 takes place by means of a tangential bel 24 running directly against the shell surfaces of the friction rollers 7 and 8. Tangential belt 24 runs through in the longitudinal direction of the machine in the direction of the Arrow 25 and drives the rollers 7 and 8 of all spinning units 1. When it is to be provided that the circumferential speeds of the rollers 7 and 8 of each spining unit 1 are to be adjusted individually, a drive for the rollers 7 and 8 corresponding to FIG. 3 is provided by means of an individual electric motor 38. This individual motor 38, via a driving pulley 37, drives an individual belt 36 which in each case is looped around the rollers 7 and 8 of a spinning unit 1. It is advantageous to arrange the individual motor 38 on a rocker that is not shown so as to be movable in a plane that is approximately perpendicular with respect to the shafts of the rollers 7 and 8 so that the individual belt 36 is selectively tightened by means of adjustment of the rocker and motor 38.

As shown in FIG. 3, the suction pipes 20 and 21 protrude with their end portions 26 from the upper end faces of the rollers 7 and 8. With their end portions 26, suction pipes 20 and 21 are clamped into bowl-shaped recesses of a roller housing 27 which itself is fastened at a support 29 of the machine frame by means of screws 28. For the clamping of the suction pipes 21 and 22, tool holders 30 are provided which also have bowl-shaped recesses and are fastened at the roller housing 27 by means of screws 31. The upper ends of the suction pipes 20 and 21 are tightly closed by means of stoppers 33.

The opening roller 5 (FIG. 3) rotates in an opening roller housing 39 that is held on a pipe 41 by means of a sleeve-type extension 40. The pipe 41 is provided with a ring collar 42 against which the opening roller housing 39 is pressed by means of a spring that is not shown. The pipe 41, on the inside of which the shaft of the feeding roller 4 is disposed, is fastened at the machine frame by fastening means that are not shown. The shank 43 of the opening roller 5 protrudes from the opening roller housing 39 and is driven by a tangential belt 44 running through in the longitudinal direction of the open-end friction spinning machine and driving the opening rollers 5 of all spinning units 1. The feeding roller 4 is connected via a coupling 50 with a driving toothed wheel 47 which is driven by means of a toothed wheel 48 of a shaft 49 running through in the longitudinal direction of the machine. By the opening of the preferably electromagnetic coupling 50, which is controlled by a yarn breakage guard that is not shown, the fiber feeding at an individual spinning unit 1 can be interrupted by stopping the feeding roller 4.

The opening roller housing 38 is covered by a cover 45 on the side facing away from the shank 43 and contains the first segment 46 of the fiber feeding duct 6, the second segment 79 of which is located in the housing part 18. The housing part 18 is held at the machine frame 52 so that it can be pivoted around a stationary shaft 51 located below the opening roller 5 in such a way that, when it is pivoting-away, the area of the wedge-shaped gap 9 is exposed for a servicing procedure.

In the travel path of the yarn between the friction rollers 7 and 8 and the withdrawal device 11, 12, a measuring device 53 is arranged at each spinning unit 1

(FIG. 3), through which the withdrawn yarn 10 passes. In particular, a yarn tension sensor is used as the measuring device 53. Embodiments are also contemplated by the invention wherein, in order to determine the quality of the yarn other yarn parameters are measured such as the diameter of the yarn. The measuring device 53 of each spinning unit 1 is connected via an electric line 54 to a signal transmitter 56 of a signal box 55 mounted at the housing part 18. A signal receiver 57 of a servicing apparatus 16 that can be moved along the open-end friction spinning machine is assigned to the signal transmitter 56. The servicing apparatus 16, which by means of running wheels 17 can be moved on rails 15 of the open-end friction spinning machine, may be constructed in such a way that it carries out the work to be explained below, but it may also be constructed in such a way that, in addition, it carries out, for example, a cleaning of the spinning units 1, a piecing after a yarn breakage or an exchanging of full winding spools 14 with empty cones. The signal receiver 57 of the servicing apparatus 16 is housed in a housing 58 connected to an evaluating device 59 which evaluates the measured values determined by the measuring device 53 and transmitted by the signal transmitter 56 and the signal receiver 57. When this evaluating device 59 determines that the yarn quality deviates from the indicated desired value, measures are initiated for adjusting the spinning conditions. When, for example, the measuring device 53 is a yarn tension sensor which determines an excessive yarn tension, this is an indication that an excessive twist is applied to the yarn 10 and that the friction effect is too high in the area of the wedge-shaped gap 9. The evaluating device 59 will then actuate an adjusting device, such as a pressure rod 61, that can be adjusted in the direction of the Arrow 62 and 63 and which is assigned to a pusher 64 of a switch 65 of the spinning unit 1 which, via an electric line 66, is connected with the control valve or valves 35 of the spinning unit. The evaluating device 59 has the effect that the suction effect is increased or reduced via the adjustment of the control valve 35 in such a way that the desired yarn quality is spun again, which condition is reported back to the evaluating device 59 via the measuring device 53, the signal transmitter 56 and the signal receiver 57.

The evaluating device 59 is also connected with a signal transmitter 67 to which a signal receiver 68 in the signal box 55 is assigned. The signal receiver 68 is connected via an electric line 69 to a control unit 70 of the individual electric motor 38 which itself, via lines 71, is connected with the control unit 70. When deviations are determined, the evaluating device 59 can therefore alternately or additionally to the adjusting of the suction effect, also individually adjust the speed of the individual motor 38 and thus the circumferential speeds of the rollers 7 and 8.

It should be pointed out that the adjusting elements of the servicing apparatus 16 are shown and explained only in diagram form. Differently operating adjusting elements may also be provided, according to contemplated embodiments of the invention, such as adjusting elements that mechanically act upon the control valve 35 and/or the control unit 70. It is also contemplated to stationarily house the evaluating device 59, for example, in the headstock of the open-end friction spinning machine and to connect it permanently to the measuring device 53 and the control valves 35 and the control units 70, so that a continuous monitoring is possible.

Figure 4:
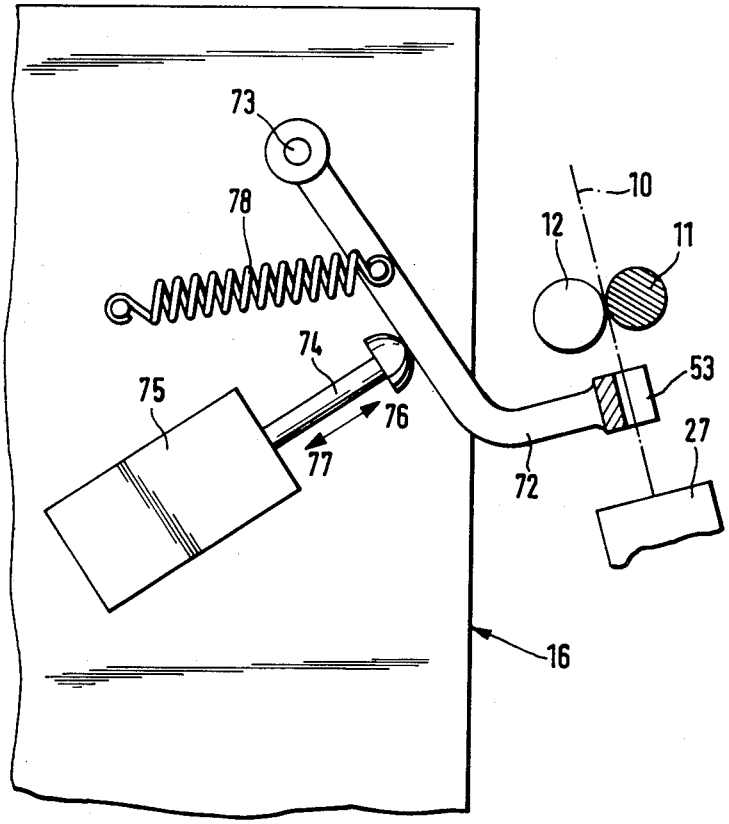
FIG. 4 is a detail schematic view showing a slightly modified servicing apparatus, constructed in accordance with other preferred embodiments of the invention.

It is also contemplated to provide only one single measuring device 53' corresponding to FIG. 4 which will then be a component of the movable servicing apparatus 16. For a monitoring process, the measuring device 53' will be periodically applied to the moving yarn between the withdrawal device 11, 12 and the friction rollers (roller housing 27). A monitoring of the quality of the spun yarn 10 at the individual spinning units 1 will then be provided only periodically. The measuring device 53' of FIG. 4 is mounted at a lever 72 that is arranged in the servicing apparatus 16 so that it can be pivoted around a shaft 73 in such a way that it can be moved into the passing yarn travel path. The application of the lever 72 and thus of the measuring device 53' takes place via a lifting piston magnet 75, the slide 74 of which can be moved out in the direction of the Arrows 77 and 76 rests against the lever 72 and causes the moving-out. The return is caused by a tension spring 78 coupled to the lever 72.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open-end friction spinning machine of the type having at least one spinning unit, each of said at least one units including:

two drivable, oppositely moving friction surface means defining a yarn formation zone for creating a friction effect, said friction effect resulting from coefficient of friction effects of the friction surface means and air flow effects at said friction surface means, friction surface driving means for driving the friction surface means during spinning operations, fiber feeding means for feeding separated fibers to the yarn formation zone, yarn withdrawal means for withdrawing formed yarn from the yarn formation zone; and suction means for applying suction forces to the yarn formation zone, wherein each spinning unit is equipped with individually adjustable friction effect changing means for changing a parameter of the friction effect in the yarn formation zone, wherein at least one measuring device means is provided for continuously directly examining the quality of the moving yarn at a spinning unit while spinning when the measuring device means is in operation at the respective spinning unit, and wherein evaluating device means are provided for evaluating the signals of the measuring device and for triggering an automatic adjustment of the friction effect changing means while spinning when deviations exist from indicated desired values.

2. An open-end friction spinning machine according to claim 1, including a plurality of said spinning units.

3. An open-end friction spinning machine according to claim 2, wherein said friction effect changing means includes means for adjusting the effect of the suction means at each spinning unit.

4. An open-end friction spinning machine according to claim 3, wherein each spinning unit is provided with an individual motor for the drive of its friction rollers, and wherein said friction effect changing means includes means for adjusting the speed of the individual motors.

5. An open-end friction spinning machine according to claim 3, wherein the measuring device means includes a measuring device provided at each spinning unit and arranged in the yarn travel path.

6. An open-end friction spinning machine according to claim 3, wherein the measuring device means includes yarn tension sensor means.

7. An open-end friction spinning machine according to claim 2, wherein each spinning unit is provided with an individual motor for the drive of its friction, surface means and wherein said friction effect changing means includes means for adjusting the speed of the individual motors.

8. An open-end friction spinning machine according to claim 7 wherein the measuring device means includes a measuring device provided at each spinning unit and arranged in the yarn travel path.

9. An open-end friction spinning machine according to claim 7, wherein the measuring device means includes yarn tension sensor means.

10. An open-end friction spinning machine according to claim 2, wherein the measuring device means includes a measuring device provided at each spinning unit and arranged in the yarn travel path.

11. An open-end friction spinning machine according to claim 10, wherein the measuring devices of the spinning units are operationally connectible to a joint evaluating device forming the evaluating device means.

12. An open-end friction spinning machine according to claim 11, wherein the evaluating device is arranged in a servicing apparatus that can be moved along the spinning machine and can be applied to the individual spinning units, said servicing apparatus being equipped with adjusting elements for actuating the friction effect changing means.

13. An open-end friction spinning machine according to claim 12, wherein the servicing apparatus is equipped with the measuring device means, said measuring device means being selectively applied to the moving yarn of respective spinning units.

14. An open-end friction spinning machine according to claim 2, wherein the measuring device means includes yarn tension sensor means.

15. An open-end friction spinning machine according to claim 1, wherein the measuring device means includes yarn tension sensor means.

16. An open-end friction spinning machine according to claim 15, wherein the yarn tension sensor means are assigned to the moving yarn in the area between the friction surface means and the yarn withdrawal means.

17. An open-end friction spinning machine according to claim 1, wherein the friction surface means comprises a pair of adjacently arranged friction rollers drivable in the same rotational direction, and the yarn formation zone comprises a wedge-shaped gap between the rollers.

18. A process for operating an open-end friction spinning machine of the type having at least one spinning unit with each of said at least one spinning unit including:

two drivable oppositely moving friction surface means defining a yarn formation zone for creating a friction effect, said friction effect resulting from coefficient of friction effects of the friction surfaces means and air flow effects at said friction surface means, friction surface driving means for driving the friction surface means during spinning operations, fiber feeding means for feeding separated fibers to the yarn formation zone, yarn withdrawal means for withdrawing formed yarn from the yarn formation zone, and suction means for applying suction forces to the yarn formation zone, said process comprising:

continuously directly measuring the quality of moving yarn at a spinning unit while spinning when the measuring device means is in operation at the respective spinning unit as compared to predetermined desired values, evaluating the quality of formed yarn with yarn quality evaluation means, and adjusting a parameter of the friction effect in response to deviations in yarn quality from desired values so as to bring the yarn quality back to the desired values.

19. Process according to claim 18, wherein said spinning machine includes a plurality of said spinning units, and wherein said adjusting is carried out by means carried on a travelling servicing apparatus which is selectively movable to individual spinning units.

20. Process according to claim 19, wherein said adjusting includes adjusting the effect of the suction means.

21. Process according to claim 19, wherein said adjusting includes adjusting the rotational speed of the friction surface means.

22. A process according to claim 18, wherein the friction surface means comprises a pair of adjacently arranged friction rollers driveable in the same rotational direction, and the yarn formation zone comprises a wedge-shaped gap between the rollers.

* * * * *